United States Patent [19]

Ludloff

[11] 4,151,446

[45] Apr. 24, 1979

[54] ELECTRONIC FLASH APPARATUS

[76] Inventor: Wolfgang H. E. Ludloff, Mainstrasse 50, Cologne, Fed. Rep. of Germany

[21] Appl. No.: 658,345

[22] Filed: Feb. 17, 1976

[30] Foreign Application Priority Data

Feb. 25, 1975 [DE] Fed. Rep. of Germany ..... 2508008

[51] Int. Cl.[2] ..... H05B 41/32; H01J 61/80

[52] U.S. Cl. ..... 315/241 R; 313/184; 315/173; 315/171

[58] Field of Search ..... 315/241 R, 241 P, 200 R, 315/205, 160, 171, 173, 241 S; 313/184

[56] References Cited

U.S. PATENT DOCUMENTS

| | | | |
|---|---|---|---|
| 2,485,037 | 10/1949 | Clark | 315/241 P |
| 2,965,790 | 12/1960 | Ittig et al. | 313/184 X |
| 3,549,945 | 12/1970 | Helmuth | 315/241 S |
| 3,697,805 | 10/1972 | Switsen | 315/241 P |

FOREIGN PATENT DOCUMENTS

| | | | |
|---|---|---|---|
| 1092128 | 11/1960 | Fed. Rep. of Germany | 315/241 P |
| 2110752 | 9/1972 | Fed. Rep. of Germany | 315/241 P |

*Primary Examiner*—Eugene R. La Roche
*Attorney, Agent, or Firm*—William R. Laney

[57] ABSTRACT

An electronic flashlight apparatus comprising a flash tube filled with a noble or inert gas of a pressure greater than the atmospheric pressure and having main electrodes and a trigger electrode arranged to receive a triggering pulse from a trigger circuit, a storage capacitor arranged to be charged by a charging circuit through at least one diode and connected across the main electrodes of the flash tube, and an auxiliary capacitor having small capcitance as compared to the storage capacitor, the auxiliary capacitor being also connected across the main electrodes of the flash tube, and being arranged to be charged through a second charging circuit to a voltage which is larger than the charging voltage of the storage capacitor.

12 Claims, 10 Drawing Figures

ELECTRONIC FLASH APPARATUS

BACKGROUND OF THE INVENTION

1. Field of the Invention

This invention relates generally to improvements in electronic flashlight apparatus and more particularly, but not by way of limitation, to electronic flashlight apparatus employing a storage capacitor and an auxiliary capacitor having small capacitance as compared to the storage capacitor.

2. Description of the Prior Art

One well known form of electronic flashlight apparatus is disclosed in Federal Republic of Germany Patent Specification No. 2,110,752. It is an object of this prior art apparatus to make the energy of a single flash variable by varying the voltage across a storage capacitor. A discharge tube filled with noble or inert gas is used as a flash tube, the gas pressure being below atmospheric pressure in the conventional manner. When a triggering pulse is applied to the trigger electrode, this flash tube will fire with full voltage of, for example, 500 volts at the storage capacitor; however, with reduction of the voltage a condition would be reached in which triggering of the flash tube is no longer possible.

In the prior art circuit, ionization of the gas within the flash tube is caused by the discharge from the auxiliary capacitor which has been charged to high voltage, so that subsequently the discharge of the storage capacitor will take place even with reduced voltage across the storage capacitor.

Flash tubes filled with noble or inert gas are used in prior art electronic flashlight apparatus, the gas pressure in these tubes being notably below atmospheric pressure and the tubes being triggered by means of the trigger electrode at storage capacitor voltages in the order of 500 volts.

SUMMARY OF THE INVENTION

It is an object of the present invention to provide an electronic flashlight apparatus, which has increased luminous efficiency as compared to prior art apparatus, i.e. an increased ratio of the available quantity of light to the electric energy supplied. This object is achieved through the use of a circuit of the type comprising a flash tube filled with a noble or inert gas at a pressure greater than the atmospheric pressure and having main electrodes and a trigger electrode arranged to receive a trigger impulse from a trigger circuit. A storage capacitor is arranged to be charged by a charging circuit through at least one diode and is connected across the main electrodes of the flash tube. An auxiliary capacitor, having small capacitance as compared to the storage capacitor, is also connected across the main electrodes of the flash tube and is arranged to be charged through a second charging circuit to a voltage which is larger than the charge voltage of the storage capacitor.

With a gas pressure within the flash tube exceeding atmospheric pressure, the flash tube would not fire at conventional storage capacitor voltages. It might be attempted to increase the storage capacitor voltage to above the conventional voltages in order to insure firing of the flash tube even with the increased gas pressure thereof. Such a measure, however, will not achieve the desired result. If the storage capacitor voltage is made so high that a flash tube of given length and with a fill-gas pressure above atmospheric pressure also fires, the storage capacitor voltage would be in a range in which there would be a considerable decrease of the luminous efficiency with decreasing voltage. In addition, increasing the voltage across the storage capacitor with given electric energy per flash would require a relatively small capacitance of the storage capacitor. Also, here it has been found that the luminous efficiency is reduced if the capacitance of the storage capacitor in relation to the cross-section of the discharge passage is reduced to below a certain level.

In the arrangement of the present invention, in comparison to the prior art apparatus, the flash tube is triggered by a discharge from the auxiliary capacitor, which has been charged to a high voltage of, for example, 1500 volts. Thus, the flash tube can be caused to fire even with the high gas pressure. The discharge proper, however, is then fed by the storage capacitor, which has been charged to a voltage optimal for the flash tube, and which is discharged through the flash tube after ionization of the fill-gas has been effected by the discharge from the auxiliary capacitor.

It has proved to be advantageous if the gas pressure of the flash tube is dimensioned in accordance with the formula $$\frac{(U)\sqrt{(g)}}{(L)\,(p)} \leq 0.1$$

where

U is the storage capacitor voltage in volts, g is the cross-section of the flash tube in square millimeters, L is the discharge distance of the flash tube in centimeters, and p is the inflation pressure in millimeters of mercury.

An optimum of the dimensioning of the storage capacitor with given cross-section of the discharge passage or of the dimensioning of the cross-section with given capacitance-determined by the electric energy to be stored per flash—is achieved when the ratio of the cross-section of the flash tube to the capacitance of the storage capacitor is essentially 1 square millimeter per 200 microfarads.

Other objects and advantages of the invention will be evident from the following detailed description when read in conjunction with the accompanying drawings.

DESCRIPTION OF THE PREFERRED EMBODIMENT

Figure 1:
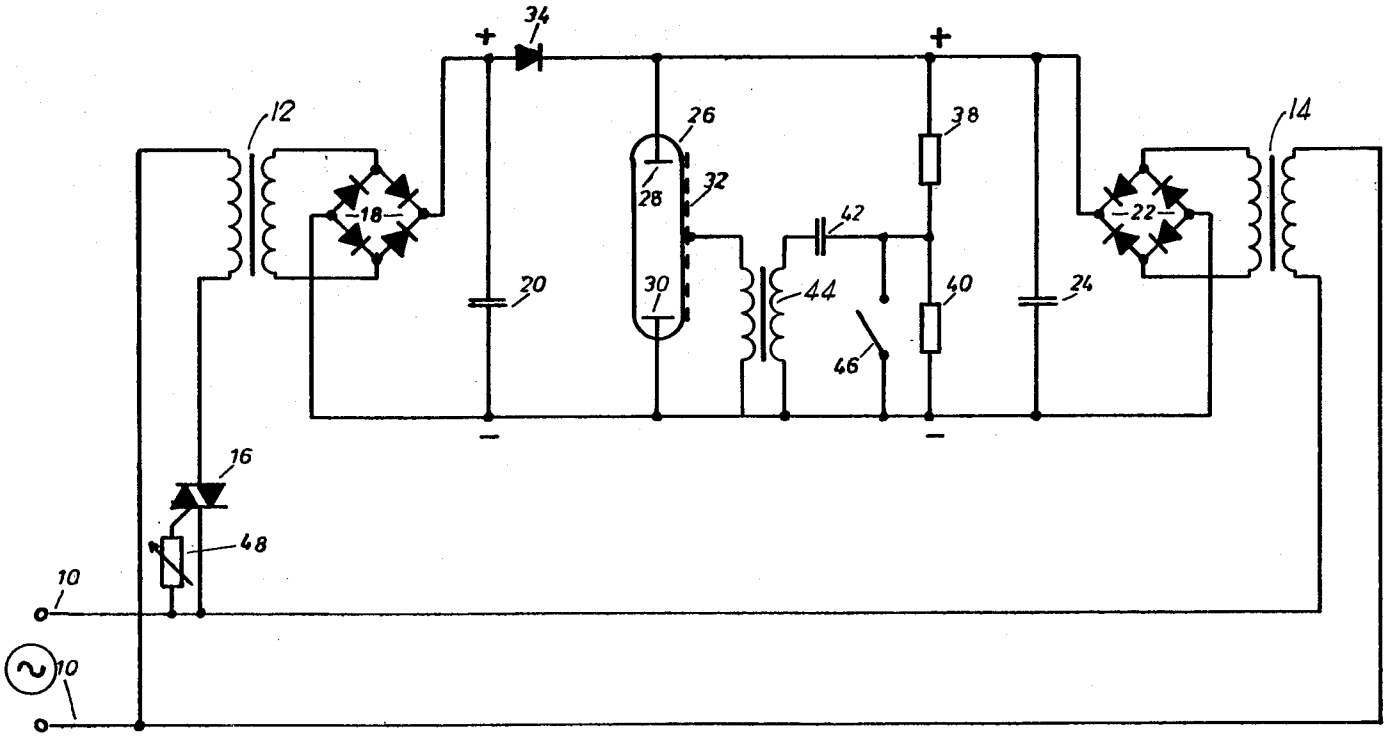
FIG. 1 illustrates a circuit diagram of an electronic flashlight apparatus constructed in accordance with the present invention.

Primary windings of two transformers 12 and 14 are fed from an alternating current source by a mains connection 10. A thyristor or triac 16 is interposed between the primary winding of the transformer 12 and one of the mains. A rectifier bridge 18 is connected across the secondary winding of the transformer 12, a storage capacitor 20 being charged through this rectifier bridge. Across the secondary winding of the transformer 14 a rectifier bridge 22 is connected through which an auxiliary capacitor 24 is charged. The capacitance of the auxiliary capacitor is small as compared to the capacitance of the storage capacitor 20. Numeral 26 designates an electronic flash tube which has two main electrodes 28, 30 and a trigger electrode 32. Connected to the main electrodes 28 and 30 is, on one hand, the storage capacitor 20 through a diode 34, and, on the other hand, directly the auxiliary capacitor 24.

Connected in parallel to the auxiliary capacitor 24 is a voltage divider consisting of the resistors 38 and 40. A trigger capacitor 42, which is connected in series with the primary winding of a trigger transformer 44, is charged through this voltage divider. The trigger capacitor 42 can be discharged through a trigger contact 46, whereby a current surge through the primary winding of the trigger transformer is generated, which surge, in turn, causes a triggering pulse to be applied to the trigger electrode 32. A variable resistor 48 interconnects the gate of the triac 16 and the main 10 to which it is connected. The resistor 48 functions to adjust the voltage level to which the storage capacitor 20 can be charged resulting in the adjustment of the light output of the flashlight apparatus.

The flash tube is a discharge tube filled with xenon or other inert gas having a gas pressure (inflation pressure) which is clearly above atmospheric pressure. In a preferred embodiment the inflation pressure is about 2000 millimeters mercury column, thus corresponding substantially to three times atmospheric pressure. However, as shown in FIGS. 2, 4, 6 and 7, good results can be obtained with an inflation pressure of about 1300 millimeters of Hg. The flash tube 26 has a U-shaped discharge vessel, the length or discharge distance of the discharge passage therein being 75 millimeters between the main electrodes 28 and 30, and the diameter of the discharge passage being 4 millimeters.

The capacitor 20 has a capacitance of, for example, 2400 microfarads and is charged to a voltage of about 360 volts. This voltage is not sufficient to cause, through the trigger electrode 32, the above-described flash tube 26 to fire. The auxiliary capacitor 24 is charged to a considerably higher voltage of about 1500 volts, and has, however, a small capacitance as compared to the storage capacitor 20. The voltage of 1500 volts is sufficient to trigger also the present high pressure flash tube 26 through the trigger electrode.

Thus the storage capacitor 20 is charged to a voltage which is smaller than the charging voltage of the auxiliary capacitor 24. Therefore the diode 34 is, at first, non-conducting. When a triggering pulse is applied by the trigger contact 46 to the trigger electrode 32, the flash tube 26 will be caused to fire and a discharge between the main electrodes develops, the auxiliary capacitor being discharged at first, through this discharge. When the voltage across the capacitor 24 has broken down through this gas discharge, the storage capacitor 20 will be discharged through diode 34. This discharge can also take place at a considerably lower voltage across the capacitor than that required to initiate the first gas discharge in the flash tube 26.

In order to determine the optimum conditions, the measured plots of FIGS. 2–7 are recorded, inflation pressure, voltage, electric power and cross-section of the discharge passage being varied. The measurement of the flash energy is carried out by means of low inertia photocell in conjunction with a ballistic galvanometer. The ordinates of the measured plots are just "scale marks," i.e., they have only relative significance. There are no substantial spectral shifts during the measurements.

Figure 2:
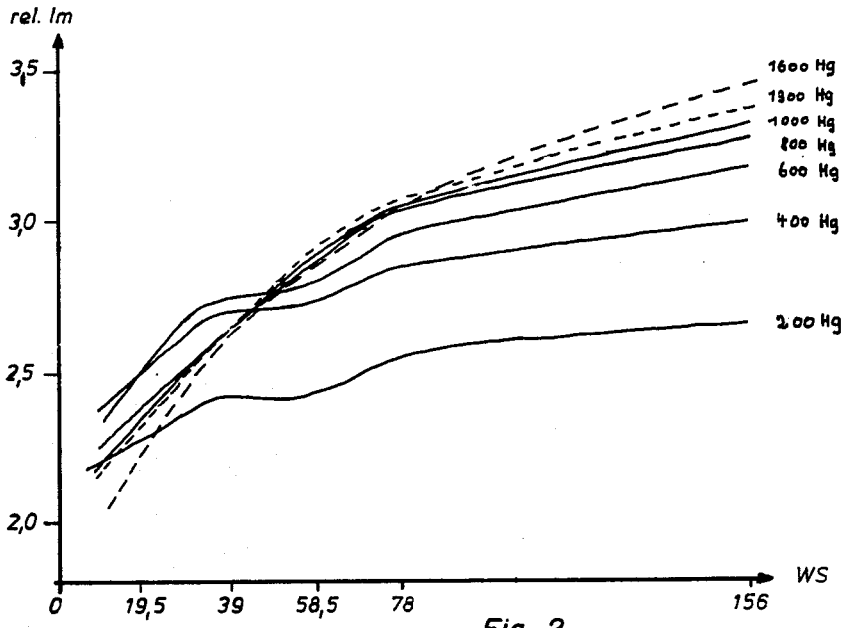
FIG. 2 is a graphical representation illustrating, for one shape of flash tube, measured plots of the relative quantity of light, i.e., of the quantity of light in relation to the electric energy spent per flash, as a function of the electric energy in each flash, the gas pressure (inflation pressure) representing the parameter of the various measured plots.
Figure 3:
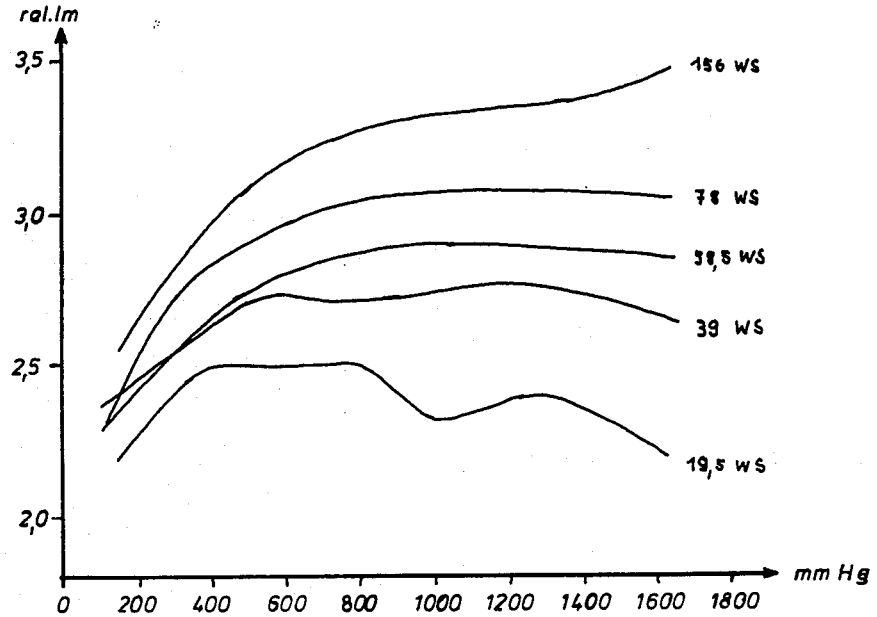
FIG. 3 is a graphical representation illustrating measured plots of the relative quantity of light as a function of the inflation pressure, the electric energy per flash representing the parameter.

From FIG. 2 can be seen, how the relative quantities of light gradually increase with increasing electric energies, measured in wattseconds (Ws), with a U-shaped flash tube of 75 millimeters length and an internal diameter of 3 millimeters. In addition, with elevated flash energies the quantity of light achieved is the higher the higher the inflation pressure is. In the range of a flash energy of about 70 wattseconds the measured plots for 1600 and 1300 millimeters mercury column intersect, so that the lower flash energies a slightly better relative quantity of light is achieved at an inflation pressure of 1300 millimeters mercury column than at higher inflation pressure. This can be seen still better from the measured plots of FIG. 3. It can be seen that the plot for 78 wattseconds has a maximum in the range of 1300 millimeters mercury column. The smaller the flash energy is the further is the maximum displaced towards small inflation pressures, the absolute value of the relative quantity of light being indeed also reduced.

Figure 4:
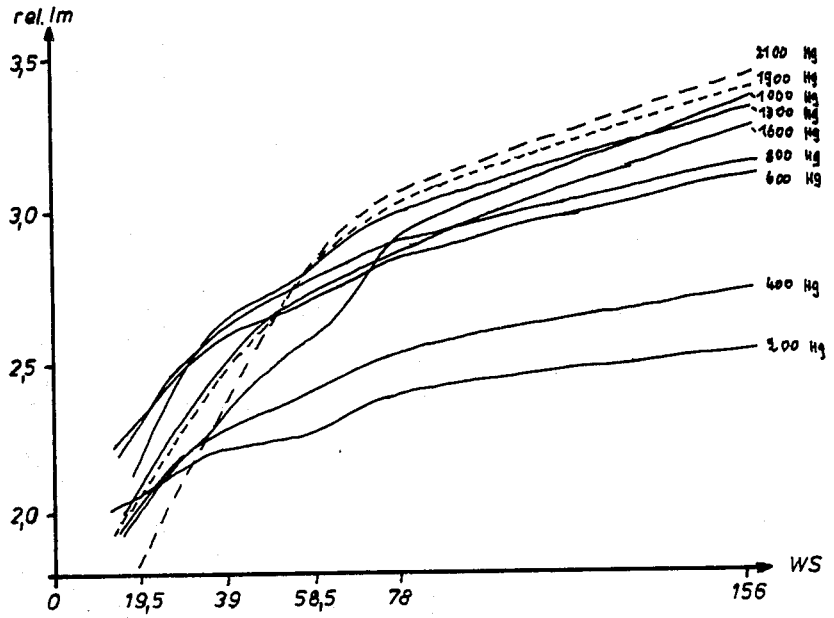
FIG. 4 is a graphical representation similar to FIG. 2, illustrating measured plots for a shape of flash tube having a different cross-section of the discharge passage.
Figure 5:
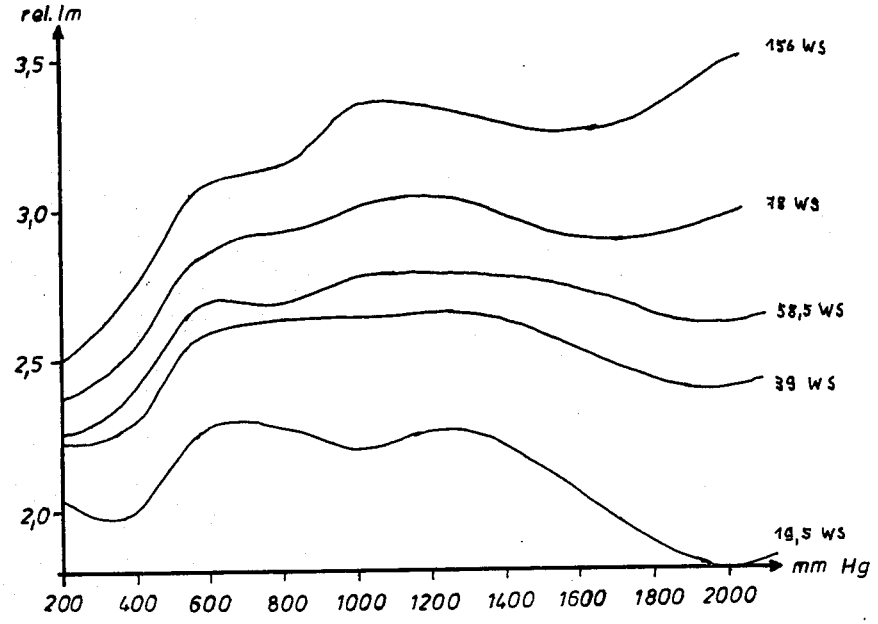
FIG. 5 is a graphical representation similar to FIG. 3, illustrating measured plots for the shape of flash tube upon which the measurements of FIG. 4 are based.

FIGS. 4 and 5 are similar graphs for a flash tube having an internal diameter of the discharge passage of 4 millimeters. Here the phenomenon is still more marked. Clearly an optimum of the inflation pressure in a range of 1300 millimeters mercury column can be recognized.

Also with the shape of tube measured in FIGS. 4 and 5 there is a clear increase of the relative quantity of light, i.e. of the ratio of the useful quantity of light emitted by the flash tube to the electric energies stored in the storage capacitor, with elevated flash energies, when an inflation pressure of 1300 millimeters mercury column is used rather than the conventional inflation pressures of, for example, 200 millimeters mercury column.

Figure 6:
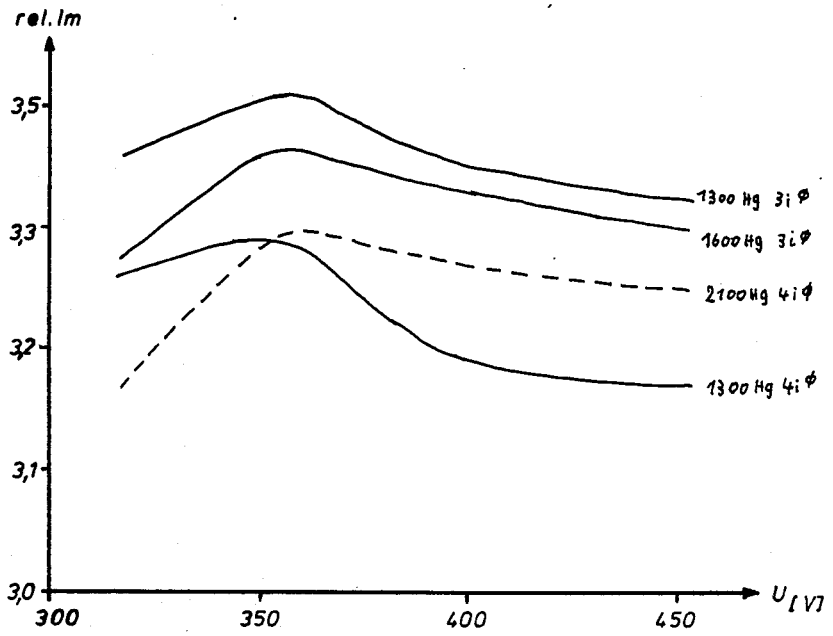
FIG. 6 is a graphical representation illustrating, for the two shapes of flash tubes, the measured plots of the relative quantity of light as a function of the voltage across the storage capacitor, the capacitance of the storage capacitor being constant and the inflation pressure as well as the shape of the flash tube representing the parameter.
Figure 7:
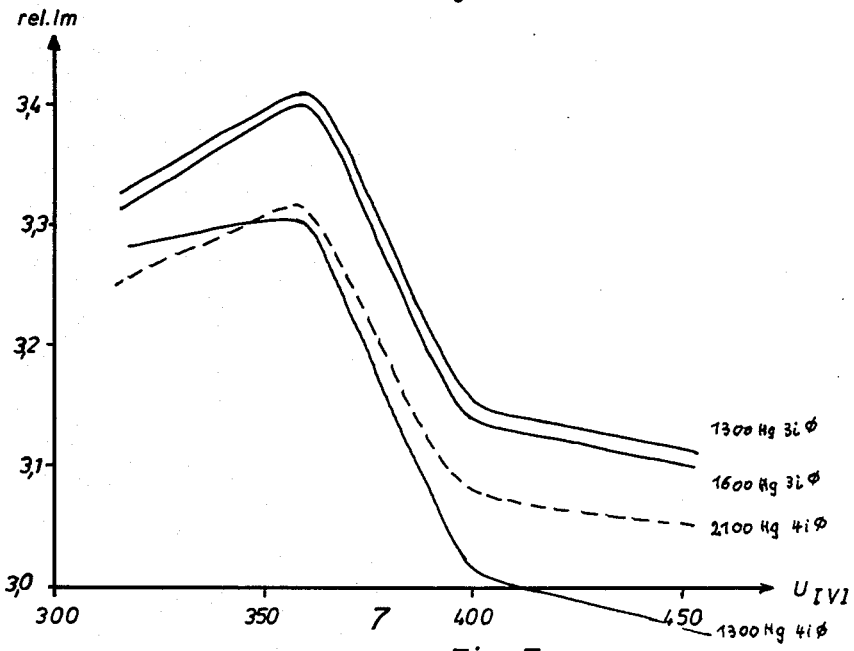
FIG. 7 is a graphical representation illustrating, for the two shapes of flash tubes, measured plots of the relative quantity of light as a function of the voltage across the storage capacitor, the electric energy of each flash being constant and the inflation pressure as well as the shape of the flash tube representing the parameter.

FIG. 6 illustrates measured plots of the relative quantity of light as a function of the voltage applied to the storage capacitor, for the two shapes of flash tube of 3 millimeters and 4 millimeters internal diameters and equal lengths of the discharge passages of 75 millimeters, as well as for different inflation pressures with constant capacitance of the storage capacitor. Here a marked maximum in the range of about 360 volts can be observed for all inflation pressures and lamp shapes, thus substantially 50 volts per centimeter discharge gap length. The course of the measured plot for 1300 millimeters mercury column with 3 millimeters internal diameter of the discharge passage is located completely above the other measured plots. For the larger internal diameter of 4 millimeters all measured plots are located further downward. The measured plots for 2100 millimeters mercury column and for 1300 millimeters mercury column intersect so that the relative light fluxes are larger for high voltages with the higher inflation pressure (2100) and for smaller voltages with the lower inflation pressure (1300).

From this data it is shown that it is advantageous if the gas pressure of the flash tube is dimensioned in accordance with the formula $$\frac{(U)\sqrt{(g)}}{(L)(p)} \leqq 0.1$$

where

U is the storage capacitor voltage in volts, g is the cross-section of the flash tube in square millimeters, L is the discharge distance of the flash tube in centimeters, and p is the inflation pressure in millimeters of mercury.

Obviously the ratio of the cross-section of the discharge passage and the capacitance of the storage capacitor 20 is critical, an optimum being achieved at 1 square millimeter per 200 microfarads.

With constant capacitance of the storage capacitor 20 the electric energy stored in the storage capacitor increases with the square of the voltage across the storage capacitor. This relationship is shown in the formula $$Ws = \tfrac{1}{2}CU^2$$

where

Ws is the electrical energy in the storage capacitor in wattseconds,

C is the capacitance of the storage capacitor in microfarads, and

U is the storage capacitor voltage in volts.

As, on the other hand, in accordance with FIGS. 2 and 4 the relative quantity of light increases with the flash power, the dependence of the relative quantity of light on the voltage does not appear very markedly in FIG. 6. The picture becomes clearer, when the apparatus is operated with always constant electric energy of, for example, 70 wattseconds, under otherwise equal conditions. This yields the measured plots of FIG. 7, from which, among other facts, it becomes clear that the relative quantity of light drops with high voltages also with high inflation pressures, and therefore operation with high voltages across the storage capacitor would not yield useful results.

Figure 8:
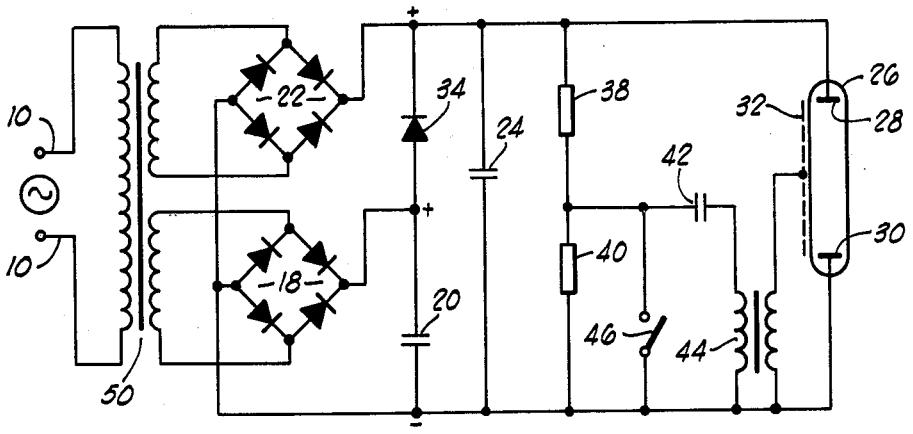
FIG. 8 illustrates a circuit diagram of a second embodiment of an electronic flashlight apparatus constructed in accordance with the present invention.

Referring now to FIG. 8, there is illustrated therein a circuit diagram of a second embodiment of an electronic flashlight apparatus constructed in accordance with the present invention. The circuit illustrated in FIG. 8 is substantially identical to the circuit disclosed in FIG. 1 with the exception that a single transformer 50 is employed in substitution for the two transformers 12 and 14 in the circuit of FIG. 1. The transformer 50 includes a primary winding fed from an alternating current source by the mains connection 10. The transformer 50 includes two secondary windings, one of which is connected across the rectifier bridge 18 and the other of which is connected across the rectifier bridge 22. The remainder of the circuitry illustrated in FIG. 8 is identical in construction and operation to the circuit illustrated in FIG. 1.

Figure 9:
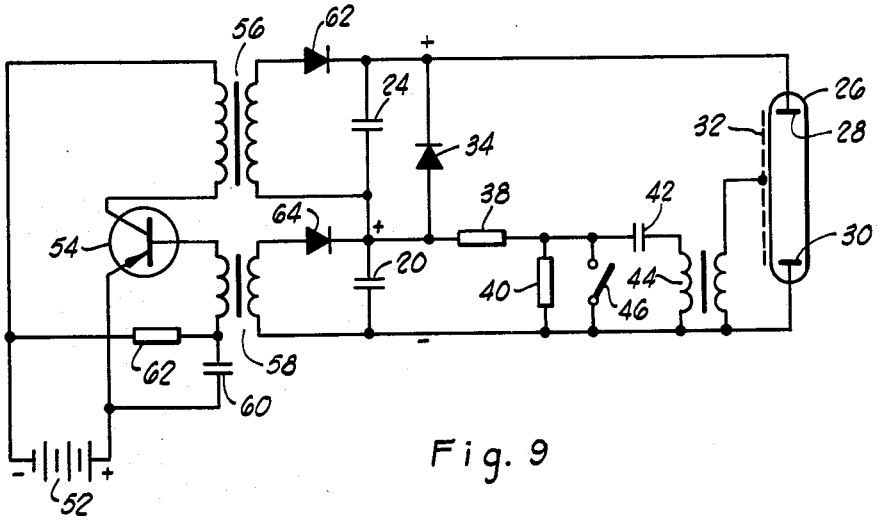
FIG. 9 illustrates a circuit diagram of a third embodiment of an electronic flashlight apparatus constructed in accordance with the present invention.

FIG. 9 illustrates a circuit diagram of a third embodiment of an electronic flashlight apparatus constructed in accordance with the present invention which is adapted to receive its operating power from a direct current source 52 which may suitably be in the form of a rechargeable or non-rechargeable battery. A substantial portion of the circuitry of FIG. 9 is identical to the circuitry of FIG. 1 and retains the same reference character designations for the elements thereof. The circuit of FIG. 9 employs a direct current-direct current converter in the form of a locking oscillator which is connected to the battery 52. The locking oscillator circuitry is of conventional design and includes a PNP transistor 54 having the emitter thereof electrically connected to the positive terminal of the battery 52 and having the collector thereof connected in series with the primary winding of a transformer 56 to the negative terminal of the battery 52. The base of the transistor 54 is connected to one end of the primary winding of a transformer 58, the other end of the primary winding of the transformer 58 being connected in series with a capacitor 60 to the positive terminal of the battery 52 and also connected in series with a resistor 62 to the negative terminal of the battery 52. In operation, the locking oscillator of FIG. 9 provides secondary positive voltage pulses through the secondary winding of the transformer 56 and a diode 62 to charge the auxiliary capacitor 24, and through the secondary winding of the transformer 58 through the diode 64 to charge the storage capacitor 20 and the trigger capacitor 42. When the capacitors 24, 20 and 42 are fully charged, the closing of the switch 46 initiates the discharge of the capacitors to illuminate the electronic flash tube 26 in a manner as specifically described above for the circuit of FIG. 1.

Figure 10:
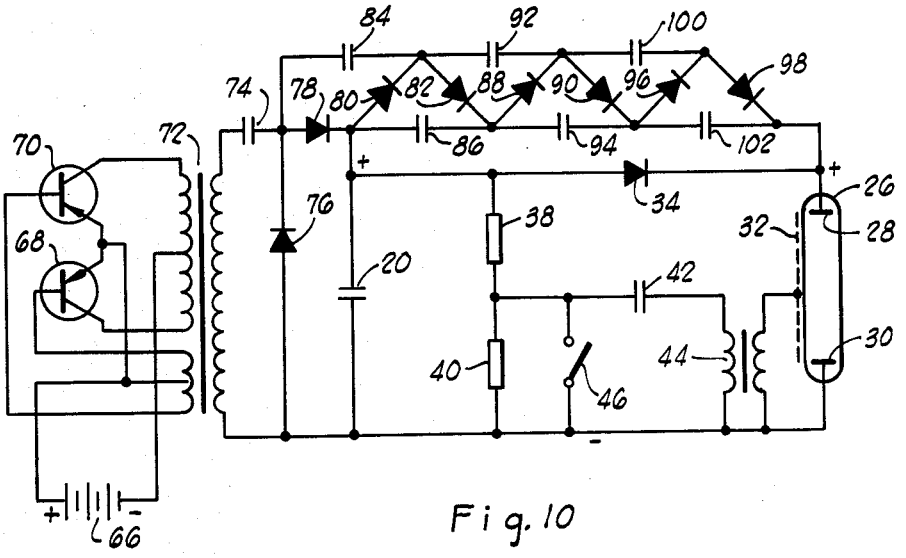
FIG. 10 illustrates a circuit diagram of a fourth embodiment of an electronic flashlight apparatus constructed in accordance with the present invention.

FIG. 10 illustrates a circuit diagram of a fourth embodiment of an electronic flashlight apparatus constructed in accordance with the present invention which, as in the circuit of FIG. 9, is adapted to receive power from a suitable direct current source 66 such as a storage battery. The battery 66 is connected to and operates a conventional push-pull oscillator. The oscillator includes a pair of PNP transistors 68 and 70. The emitters of the transmitters 68 and 70 are both electrically connected to the positive terminal of the battery 66 while the collectors of the transistors 68 and 70 are connected respectively to the opposite ends of a primary winding of a transformer 72. The negative terminal of the battery 66 is connected to a center tap of the primary winding connected between the collectors of the transistors 68 and 70. The bases of the transistors 68 and 70 are connected respectively to the opposite ends of a second primary winding of the transformer 72. A center tap of the primary winding connected in series between the bases of the transistors 68 and 70 is connected to the positive terminal battery 66. This oscillator circuitry provides a symmetrical alternating current output from the secondary winding of the transformer 72 in response to the direct current input from the battery 66.

One side of a capacitor 74 is connected to one end of the secondary winding of the transformer 72 while the second end of the secondary winding is connected to one side of the storage capacitor 20. A diode 76 is connected between the second side of the capacitor 74 and one end of the secondary winding of the transformer 72. A second diode 78 is connected between the capacitor 74 and the storage capacitor 20. A voltage multiplier circuit comprising three cascade voltage doublers combined in series provides a high auxiliary voltage to the main electrode 28 of the flash tube 26. The first voltage doubler comprises the diodes 80 and 82 and the capacitors 84 and 86, the second voltage doubler comprises the diodes 88 and 90 and the capacitors 92 and 94 and the third voltage doubler comprises the diodes 96 and 98 and the capacitors 100 and 102. The sum of the voltages across the series connected capacitors 86, 94 and 102 provides the charging voltage for the flash tube 26 and is substantially identical to the charging voltage across the auxiliary capacitor 24 in the circuit of FIG. 1. As in the circuit of FIG. 1, the diode 34 in the circuit of FIG. 10 is, at first, non-conductive. When a triggering pulse is applied by the trigger contact 46 to the trigger electrode 32, the flash tube 26 will be caused to fire and a discharge between the main electrodes develops, the capacitors 86, 94 and 102 discharged at first, through this discharge. When the voltage across the capacitors 86, 94 and 102 has broken down through this gas discharge, the storage capacitor 20 will be discharged through the diode 34 and between the main electrodes. As in the circuit of FIG. 1, this discharge can also take place at a considerably lower voltage across the capacitor 20 than that required to initiate the first gas discharge in the flash tube 26.

Changes may be made in the combination and arrangement of parts or elements as heretofore set forth in the specification and shown in the drawings without departing from the spirit and scope of the invention as defined in the following claims.

What is claimed is:

1. In an electronic flash apparatus of the type which includes:

a closed flash tube having main electrodes with a discharge distance therebetween, a cross-sectional area, and trigger electrode means for receiving a triggering pulse;

trigger circuit means for supplying a trigger impulse to the trigger electrode means;

storage capacitor means for receiving and discharging an electrical charge and connected across the main electrodes of said flash tube;

auxiliary capacitor means having small capacitance as compared to the capacitance of said storage capacitor means and connected across the main electrodes of said flash tube for receiving and discharging an electrical charge;

first charging circuit means for charging said storage capacitor means through at least one diode to a first charging voltage; and second charging circuit means for charging said auxiliary capacitor means to a second charging voltage greater than the first charging voltage of said storage capacitor means, the improvement comprising:

a quantity of inert gas contained within the closed flash tube, the pressure of the gas in said flash tube being substantially greater than the atmospheric pressure and said flash tube, said pressure and said storage capacitor means being dimensioned in accordance with the formula $$\frac{(U)\sqrt{(g)}}{(L)\,(p)} \leqq 0.1$$

where "U" is the storage capacitor voltage in volts, "g" is the cross-sectional area of the flash tube in square millimeters, "L" is the discharge distance of the flash tube in centimeters, and "p" is the gas pressure in millimeters of mercury.

2. The electronic flash apparatus as set forth in claim 1, characterized further in that the gas pressure of the flash tube is substantially twice the atmospheric pressure.

3. The electronic flash apparatus as defined in claim 2, characterized further in that the ratio of the first charging voltage of said storage capacitor means to the discharge distance of the flash tube in centimeters is substantially 50 volts per centimeter.

4. The electronic flash apparatus as defined in claim 3, characterized further in that the ratio of the cross-sectional area of said flash tube in square millimeters to the capacitance of said storage capacitor means in microfarads is substantially one square millimeter per 200 microfarads.

5. The electronic flash apparatus as set forth in claim 1, characterized further in that the inert gas is xenon gas.

6. The electronic flash apparatus as set forth in claim 1, characterized further in that the gas pressure of the flash tube is approximately in the range of from 1300 to 2100 millimeters of mercury and the cross-sectional area of the flash tube is approximately in the range of from 7.07 to 12.57 square millimeters.

7. In an electronic flashlight apparatus of the type which includes:

a closed flash tube having main electrodes with a discharge distance therebetween, a cross-sectional area, and trigger electrode means for receiving a triggering pulse;

trigger circuit means for supplying a triggering pulse to the trigger electrode means;

storage capacitor means for receiving an electrical charge and discharging an electrical charge across the main electrodes of said flash tube;

auxiliary capacitor means having small capacitance as compared to the capacitance of said storage capacitor means for receiving an electrical charge and discharging an electrical charge across the main electrodes of said flash tube;

first charging circuit means for charging said storage capacitor means to a first charging voltage; and second charging circuit means for charging said auxiliary capacitor means to a second charging voltage greater than the first charging voltage of said storage capacitor means, the improvement comprising:

a quantity of gas filling the closed flash tube, the pressure of the gas in said gas tube being greater than the atmospheric pressure and said flash tube, said pressure and said storage capacitor means being dimensioned in accordance with the formula $$\frac{(U)\sqrt{(g)}}{(L)(p)} \leqq 0.1$$

where "U" is the storage capacitor voltage in volts, "g" is the cross-sectional area of the flash tube in square millimeters, "L" is the discharge distance of the flash tube in centimeters, and "p" is the gas pressure in millimeters of mercury.

8. The electronic flashlight apparatus set forth in claim 7 characterized further in that gas pressure of the flash tube is approximately 1300 millimeters of mercury, the cross-sectional area of the flash tube is approximately 7.07 square millimeters, the discharge distance of the flash tube is approximately 75 millimeters, and the first charging voltage of the storage capacitor is approximately 360 volts.

9. The electronic flashlight apparatus as defined in claim 7, characterized further in that the ratio of the first charging voltage of said storage capacitor means to the discharging distance of the flash tube in centimeters is substantially 50 volts per centimeter.

10. The electronic flashlight apparatus as defined in claim 7, characterized further in that the ratio of the cross-sectional area of said flash tube in square millimeters to the capacitance of said storage capacitor means in microfarads is substantially one square millimeter per 200 microfarads.

11. The electronic flashlight apparatus as defined in claim 7, wherein said first charging circuit means is characterized further to include:

means for adjusting the first charging voltage of said storage capacitor means to vary the light output of said apparatus.

12. The electronic flashlight apparatus as defined in claim 7, characterized further in that the gas is xenon gas.

* * * * *